US005125309A

United States Patent [19]

Stanwood

[11] Patent Number: 5,125,309

[45] Date of Patent: Jun. 30, 1992

[54] ADJUSTABLE FRICTION GRAND PIANO ACTION

[76] Inventor: David C. Stanwood, R.F.D. 340, Vineyard Haven, Mass. 02568

[21] Appl. No.: 640,914

[22] Filed: Jan. 11, 1991

[51] Int. Cl.[5] ..... G10C 3/18

[52] U.S. Cl. ..... 84/239

[58] Field of Search ..... 84/236, 237, 238, 239, 84/240

[56] References Cited

U.S. PATENT DOCUMENTS 48,565 7/1865 Koth ..... 84/236

872,551 12/1907 Anderson ..... 84/236

*Primary Examiner*—L. T. Hix

*Assistant Examiner*—Eddie C. Lee

*Attorney, Agent, or Firm*—William Nitkin

[57] ABSTRACT

An adjustable friction grand piano hammer shank having bifurcated ends disposed on either side of a flange with a slot defined in each bifurcated end, a pivot pin receipt hole defined in each bifurcated end aligned with the slots, a strap having one end affixed to the bottom of one of the bifurcated portions extending therearound to form a loop around an adjustment screw with the strap's other end extending around the other bifurcated end to be affixed to the bottom of the other bifurcated end such that tightening the screw pulls on the strap and tightens together the portions of the bifurcated hammer shank ends above and below the slots to increase friction against the pivot pin and conversely, loosening the adjustment screw releases tension on the strap allowing the ends above and below the slot to be under less tension and reducing friction on the pivot pin.

3 Claims, 2 Drawing Sheets

ADJUSTABLE FRICTION GRAND PIANO ACTION

BACKGROUND OF THE INVENTION

1. Field of the Invention

This invention resides in the area of grand piano key and hammer actions and more particularly relates to a grand piano action with an improved adjustable friction hammer flange pivot design.

2. Description of the Prior Art

To a pianist, it is important that the pressure required to depress the piano keys feel uniform across the keyboard. If every key feels alike, the pianist can exert greater control over the volume of the musical tones produced, making the piano easier to play as well as allowing the pianist to play more expressively. For instance, if each key requires the same pressure to produce a given volume, the pianist can easily play a series of notes at the same volume by applying the same pressure to each key. If, on the other hand, each key requires a different pressure to produce a given volume, the pianist has the difficult task of learning how much pressure to apply to each key at a particular piano in order to play a series of notes at the same volume. Therefore it is considered desirable to build a piano action so that there is uniform "feel" in each key.

The grand piano is a stringed keyboard instrument which uses a key-activated mechanical system called an "action" to produce musical tone of varied intensity from the strings and soundboard.

Grand piano actions typically have a keyboard consisting of eighty-eight keys. Each key consists of a series of wooden pivots and levers designed so that the pianist can strike the key and thereby propel the piano hammer into the strings with force sufficient to create musical tone from the strings and soundboard. Specifically, each key has three pivoted levers: the hammer shank, the wippen, and the key lever. When the key is at rest, the weight of the hammer shank, with its attached hammer and knuckle, rests on top of the wippen which in turn rests on top of the back side of the key lever at the capstan. The weight of the action parts on the back side of the key causes the iron of the key, pivoted on the balance rail, to rest in an elevated position such that the bottom side of its proximal end is approximately three-eighths of an inch above the front rail. For the piano action to work properly, there must be sufficient weight on the back side of the key so that the force of gravity can act to return the front side of the key to its rest position after being depressed.

To play a note, the pianist strikes downwards with his finger against the upper proximal surface of the key, causing the front of the key to move downwards. As the front of the key moves down, the key pivots at the balance point, causing the back end of the key to move upwards, pushing up the wippen and hammer shank with its attached hammer thereby propelling the hammer into the string, creating a musical tone. When released, the key comes to rest in its former position with the lower side of its proximal end three-eighths of an inch from the front rail.

The ability to create musical tone of varied volume is of primary importance to the pianist. In order to play specific levels of volume, the pianist has to be able to control precisely the speed of the hammers as they strike the strings. The pianist senses how fast the hammer is being propelled to the string by feeling how much pressure is exerted against the key as it is depressed. The greater the pressure, the higher the volume of the tone produced.

When depressing a key, the pianist feels a certain amount of force from the weight of the parts. In addition, the pianist feels a significant force of resistance resulting from friction between the moving parts of the action. In other words, the resistance that is felt in the key has both a weight component and a frictional component.

Manufacturers of pianos are careful to make the weight of the action parts uniform. In this way they can make the weight component of key resistance reasonably uniform. However, the frictional component of key resistance is more difficult to control. Friction causes problems in piano actions because it changes frequently and unpredictably, both daily and seasonally, due to such factors as changes in humidity and wear of parts. When friction changes, the key resistance changes.

Unstable friction is an inherent trait of piano actions because to this date the only material found suitable for the fabrication of action parts is high-grade, well-seasoned hardwood. Even the most well-seasoned wood, however, will expand and contract under varied conditions of climate and humidity. Unfortunately the effects of this expansion and contraction are unpredictable and cause friction in the action pivots to change unpredicably. Because friction changes unpredictably, the frictional component of key resistance invariably becomes non-uniform from key to key, making the action feel uneven to the pianist. Keeping friction at a constant level, in order to maintain uniform key resistance, is a major problem for piano makers.

In particular, the hammer shank pivot has a major influence on friction levels in the action. If a hammer shank pivot becomes tight, it will have the effect of making the key feel sluggish and difficult to press. If it is too loose, the key plays too easily and the pianist has difficulty sensing the movement of the hammer, making it difficult to control the action. Actions with low friction tend to be difficult to control, akin to driving a car with no brakes. Pianists like to play on actions which have a certain degree of friction, not too much or too little.

The friction level in each key can be controlled by adjustment of the friction in the hammer flange pivot. Heretofore, the methods used for controlling friction in the hammer shank pivots have proven to be impractical. In the past, piano manufacturers have tried to solve the friction problem with the aid of adjustable friction hammer flange pivot designs. There exist a number of hammer shank pivot designs which utilize a screw adjustment for adjusting friction levels in the hammer flange pivot to variably tighten against the brass pin retaining the bifurcated hammer shank. This approach is theoretically highly desirable because levels of frictional resistance can be individually adjusted and maintained in each key by simply turning a screw. However, the adjustable friction hammer pivot designs heretofore tried have been unsuccessful.

In the mid-nineteenth century it was common to find square grand pianos with actions that used a type of hammer shank pivot which had an adjustment screw bearing against the pin which could be tightened or loosened, thereby raising or lowering the friction in the pivots. However, this design is not compatible with the type of action currently used in grand pianos. Also, it was difficult to accurately control friction with this design, and the design was complicated and expensive to produce due to the small screws and area of insertion. Also the design is generally incompatible with today's design requirements.

Erard, the French piano-making firm, utilized a similar type of adjustable friction hammer shank pivot in the pianos it produced during the nineteenth century. Later its use was discontinued. The Erard adjustable hammer shank pivot was used in an action design that is similar to today's grand piano action. In fact, the modern piano action evolved out of the design of the Erard action which was invented in 1829 by Sebastian Erard. However, the design of the Erard adjustable friction hammer shank pivot was not readily adaptable to the design requirements of the modern action because of the orientation of its components. It was expensive to produce and because it was made of brass, it was prone to failure from metal fatigue. Also, it was difficult to turn the adjustment screw in order to effect a fine degree of control of the level of friction in the pivot.

By the latter part of the nineteenth century, all grand piano makers had adopted the same system for making hammer shank pivots in which system the friction parameters of the pivots are set in the factory. This system is stil in general use today. It utilizes a wooden hammer shank with a bifurcation on the shank side. In both sides of the bifurcation are drilled small holes which are lined with felted wool cloth. The bifurcated portion of the hammer shank fits around a wooden flange which is fixed on the hammer flange rail. A hole is drilled in the flange such that it lines up with the cloth-lined holes in both sides of the bifurcated hammer shank end. A brass pin is then inserted through all three holes and cut off flush on the outer side of each fifurcated hammer shank end. The hole in the flange is drilled undersize so that the brass pin will be held generally non-rotatably therein. Friction is preset in the factory by matching the size of the pin with the cloth-lined holes in each bifurcated hammer shank end such that the hammer shank is held securely to the hammer flange while still being able to rot ate freely around the axis of the brass pin. Presetting friction requires a high degree of skill on the part of the workers responsible for assembling parts in the factory.

The problem with this system of "presetting" friction comes from the fact that the friction levels as set in the factory do not remain constant after the parts are assembled. If friction in the action pivots changes, the only way to reset the friction is to disassemble the parts and rematch the brass center pins with the cloth holes. This procedure is time-consuming and costly and still does not guarantee frictional stability. Once repaired, friction levels will still change under various conditions of use.

As a result, manufacturers of pianos tend to address only the most visible problem associated with action friction, namely sluggish or stuck keys resulting from high friction, by reducing friction in the hammer shank pivots to a minimum during the manufacturing process. In addition, dry lubricants such as graphite or teflon are often added to the cloth in the hammer shank pivot in order to try to prevent pivots from becoming tight. This practice may help reduce the chances of hammer shank pivots becoming tight, but it does not eliminate frictional changes. Also, this approach tends to produce actions that don't have enough friction.

The shortcomings of the hammer shank pivot frictional control designs previously used and the drawbacks of the system now in general use by piano manufacturers demonstrate the need for a practical hammer shank pivot design which allows for quick and easy adjustment of friction, thereby allowing for compensation of friction levels in each key in order to maintain a uniform "feel" to the piano's action. Today's manufacturers of pianos have given up on the concept of adjustable hammer shank friction as impractical.

SUMMARY OF THE INVENTION

It is an object of this invention to provide a grand piano hammer shank pivot design which gives the user the ability to quickly, easily and accurately adjust the level of friction in the hammer shank pivot over a wide range of values in order to provide a means of maintaining uniform key resistance by compensating for changes in friction resulting from extremes in the ambient humidity or from wear of parts.

It is also an object of this invention to provide a means by which the frictional component of key resistance can be set at varied uniform levels in order to match the feel of the action to the desires of the pianist.

It is a further object of this invention to provide an adjustable friction grand piano hammer shank pivot structure which can be adapted to conventional hammer shank structure so that piano manufacturers can easily and economically install my new structure. It is a still further object to provide an adjustable friction hammer shank pivot structure which is inexpensive to manufacture, requiring a lower skill level on the part of workers responsible for assembly of action parts in the factory.

It is yet a further object of this invention to provide an adjustable hammer flange pivot structure which is reliable over long periods of use as well as easy and simple to repair.

As discussed above, in the art of piano playing, it is of paramount importance that the action feel uniform to the pianist. In current piano action manufacture, it is impossible to counteract effectively the destabilizing effect that friction has on key resistance. This problem is aggravated by a number of factors. Manufacturers are pressured, for economic reasons, to minimize the time taken to season the wood used for the production of action parts. This practice produces wood which is more apt to change dimensionally once assembled, thereby causing frictional problems in the action pivots. Also it is becoming more difficult and expensive to find high-grade wood which is appropriate for use in piano actions. The conventional system of assembling parts requires a high degree of skill which factor puts an additional burden on the manufacturer in the training and maintenance of a skilled work force and in maintaining quality control in the finished product. Even under the most ideal conditions the uniformity of friction levels progressively degrades through the life of the action.

As a result of these factors, manufacturers tend to focus on addressing the most visible problem associated with high friction, namely sluggish or sticking action resulting from high friction. The reduction of friction in the hammer shank pivot to a minimum tends to produce a low-friction type of action which is not necessarily what all pianists desire. Previous attempts have been made to alleviate friction problems by providing for adjustment of friction in the hammer shank pivot but such attempts have been unsuccessful.

The structure of my invention makes it possible to incorporate piano action design in an affordable and reliable manner. Production and assembly of the hammer shank pivots using my invention requires lower skill levels thereby lightening the burden on the manufacturer to maintain a highly skilled labor force. Changes in action friction levels can be compensated for in the field by simple adjustment of a friction adjust screw. The use of my invention will reduce callback and warranty problems which currently plague grand piano manufacturers. Uniform key resistance can also be maintained at a high level for the life of the action. In addition, my invention makes it possible for the pianist to have frictional resistance adjusted at a level to suit his or her style of playing.

The structure of this invention economically and reliably eliminates a whole range of problems which piano makers have previously faced, making it possible to attain a level of uniformity in key resistance that wa previously unattainable.

DESCRIPTION OF THE PREFERRED EMBODIMENT(S)

Figure 1:
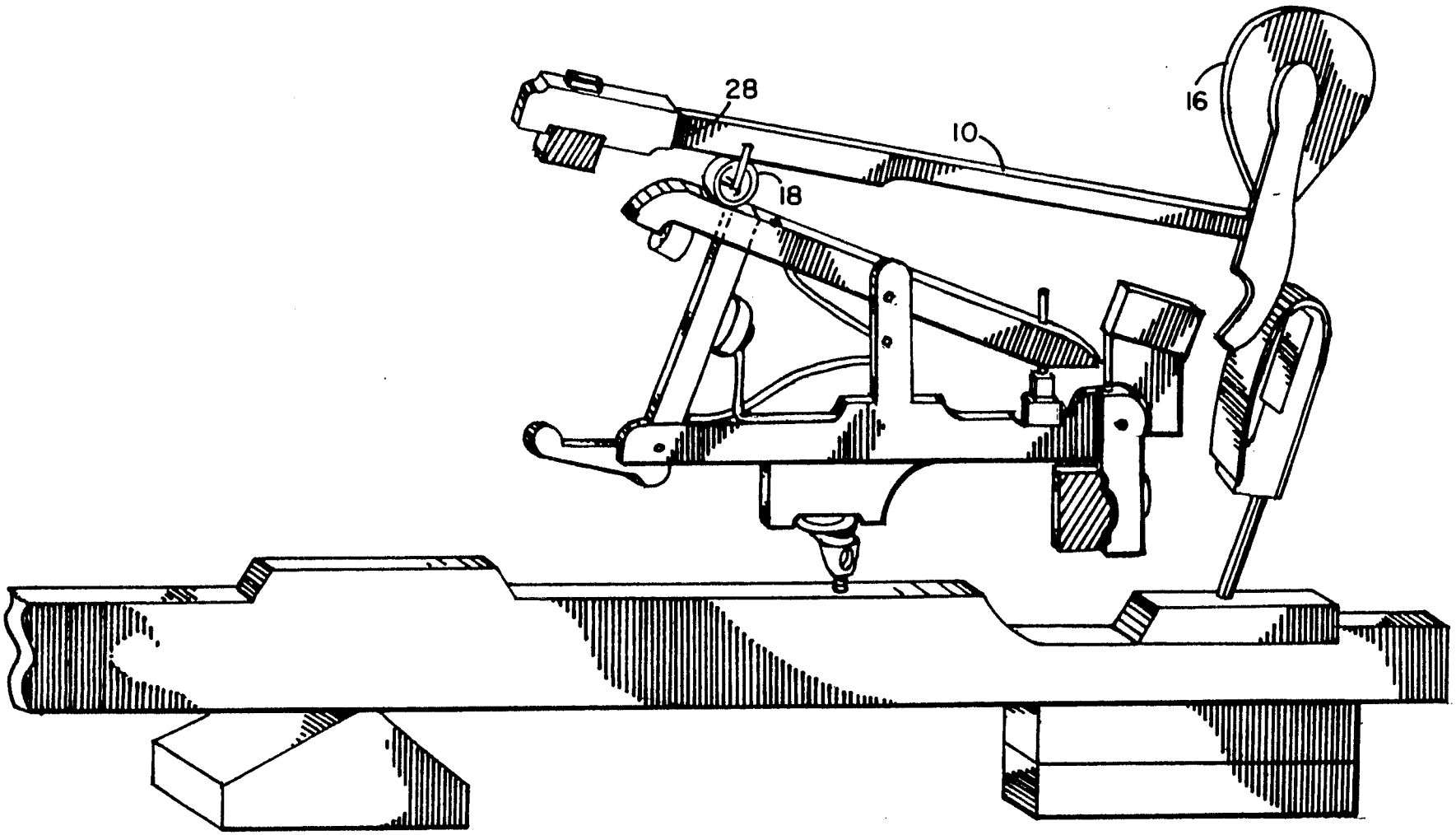
FIG. 1 PRIOR ART
FIG. 1 illustrates a side elevational view of a prior art piano action.
Figure 2:
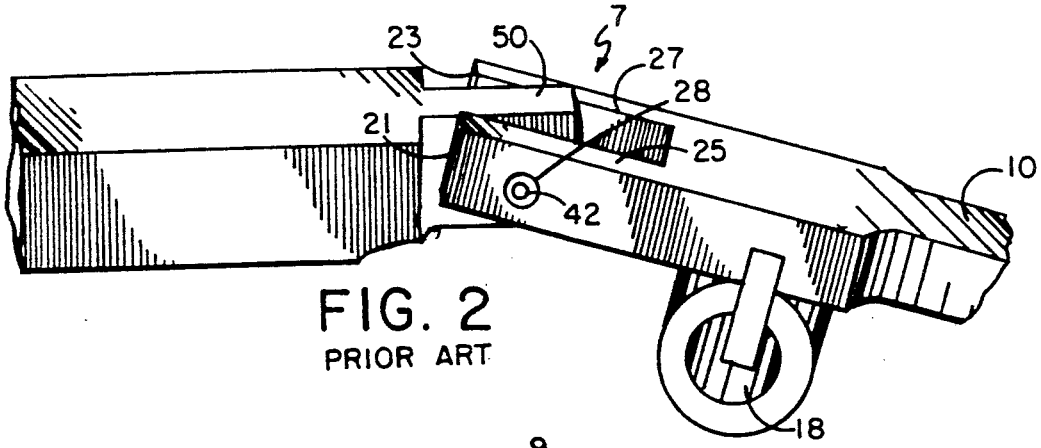
FIG. 2 PRIOR ART
FIG. 2 illustrates a perspective view of a typical hammer flange pivot in prior art actions.
Figure 3:
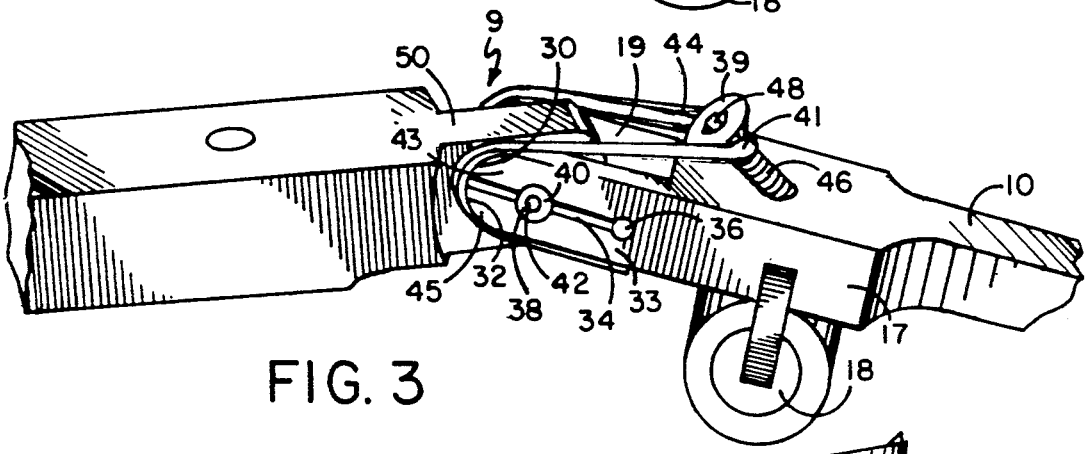
FIG. 3 illustrates a perspective view of the structure of this invention.

FIG. 1 illustrates the general mechanism of a key from prior art grand piano movements. FIG. 3 illustrates the adjustable friction hammer shank pivot assembly 9 utilizing the structure of this invention. The adjustable friction hammer shank pivot seen in FIG. 3 is contrasted to a typical prior art hammer flange pivot 7 as illustrated in FIG. 2. In FIG. 2 flange 50 is sandwiched by bifurcated hammer shank ends 25 and 27 with pin 42 passing therethrough to act as a pivot point. Hammer shank 10 is shown with knuckle 18 therebelow. Tips 21 and 23 of first and second bifurcated hammer shank ends 25 and 27 are squared off. The structure of this invention seen in FIG. 3 shows that the bifurcated portions of the ends of the hammer shank are rounded to form curved ends 30 and 32. In addition, a slot 34 is cut from the end of the hammer shank approximately one-half inch in length through a center line drawn through both bifurcated end portions 17 and 19 of hammer shank 10, creating an upper hammer shank end portion 43 and a lower hammer shank end portion 45 at the end of each hammer shank bifurcation. At the end of each slot 34 is drilled a small strain relief hole 36. Holes 38 to receive and support pivot pin 42 are drilled in the bifurcated portions at the middle of both slots, one defined in each of said first and second bifurcated hammer shank ends. Holes 38 are lined with felted wool cloth 40 into which is inserted pivot pin 42 which can be brass or equivalent material. Pivot pin 42 passes through an undersized hole formed in wooden flange 50 so that the pivot pin is non-rotatably secured in flange 50 which allows the pivot pin to pivot against the wool cloth when the hammer shank moves. Thin strap 44 made of an appropriately strong, non-stretchable, flexible material such as plastic, metal or even wire is attached by gluing, screwing or equivalent means to curved end 32 and lower surface 33 of each lower bifurcated portion of the hammer shank below slot 34. Strap 44 passes freely around the top curved surface 30 of each hammer shank bifurcation end and loops around the top of friction adjust screw 46. Friction adjust screw 46 can be a flat-headed screw with a socket 48 or equivalent screwed into hammer shank 10 at a rearwardly disposed angle generally above knuckle 18. Screw 46 has lip 39 around its top which catches loop 41 of strap 44. Strap 44 then extends down and around the parallel bifurcated portion 19 and is attached at its lower surface, not seen in FIG. 3, in the same way as it is attached to lower curved end 32 and lower surface 33 on the visible portion of bifurcated portion 17.

Friction in the hammer shank pivot is increased or decreased by inserting a socket driver into the socket 48 of friction adjust screw 46 and tightening or loosening the friction adjust screw as needed, for instance, tightening the friction adjust screw increases the tension on strap 44 by forcing it forward. Increasing tension in the strap has the effect of exerting an increased lateral force against the upper curved end portions 30 of the hammer shank bifurcations. This force causes the upper portion 43 of the split end of the bifurcation of the hammer shank to flex downward, causing the surface of felted cloth 40 to be pushed more tightly against pivot pin 42, thereby increasing friction in the pivot. Decreasing tension in strap 44 by loosening friction adjust screw 46 has the opposite effect, allowing strap 44 to move rearward from the release of tension and thereby decreasing the lateral force on the upper curved end of the hammer shank bifurcations, thereby reducing friction between the felted wool cloth and the pivot pin.

Figure 4:
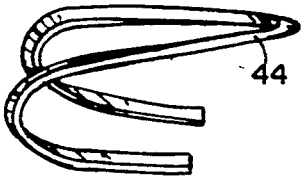
FIG. 4 illustrates a perspective view of the tension adjusting strap.
Figure 5:
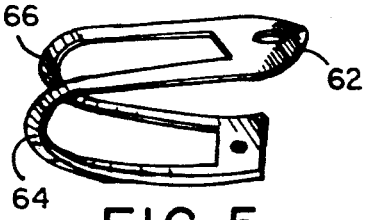
FIG. 5 illustrates a perspective view of the tension adjusting strap made of a molded plastic construction.

FIG. 4 shows a perspective view of tension adjust strap 44. This strap can also be made in the form of an injection molded bridle 62 as shown in FIG. 5 which has the advantage of maintaining a more accurate alignment of strap elements 64 and 66.

Figure 6:
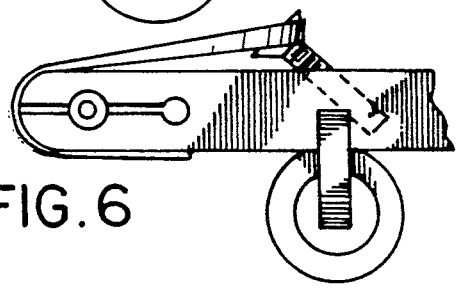
FIG. 6 illustrates a side elevational view of the structure of this invention.
Figure 7:
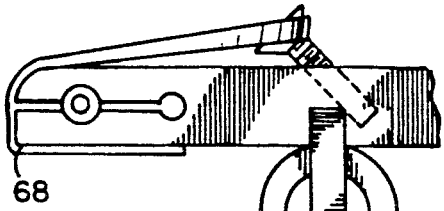
FIG. 7 illustrates a side elevational view of an alternate embodiment of the structure of this invention.

FIG. 6 shows a perspective view of the invention. By comparison FIG. 7 shows how the shape of lower surface 68 could be changed from curved end 32, as seen in FIG. 6, if desired in order to simplify the machining processes necessary in fabricating the movement parts.

Figure 8:
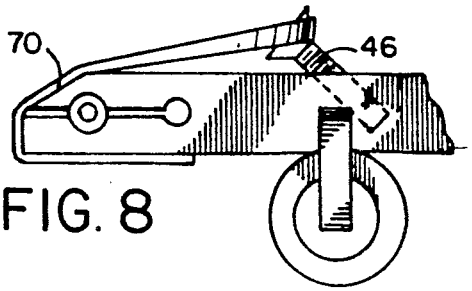
FIG. 8 illustrates a side elevational view of a further alternate embodiment of the structure of this invention.

FIG. 8 shows how the shape of upper surface 70 of the bifurcated end portion 17 may be shaped to form a lower angle. This type of upper surface design requires higher tension in strap 44 in order to maintain friction in the pivot. This higher strap tension would make adjustment of friction levels easier by requiring more turns of screw 46 in order to effect small changes in pivot friction.

This method of friction adjustment has a significant advantage over the prior art because only a minor percentage of the tenson in the strap goes to exerting a lateral tightening force on the hammer shank ends. In prior art designs very slight changes in the turning of an adjustment screw would effect very large changes in the friction, making fine adjustment of the friction difficult to achieve. In the structure of this invention it takes several turns of the screw in order to effect a noticeable change in friction. Therefore fine adjustment of friction is more easily and accurately achieved.

A further advantage of my invention is that it relies on tension in the strap to exert lateral force on the hammer shank pivot. The force of tension to which strap 44 is exposed is only a fraction of the tensile breaking strength of the strap. Therefore chances of the strap breaking or failing during use are small.

Although the present invention has been described with reference to particular embodiments, it will be apparent to those skilled in the art that variations and modifications can be substituted therefor without departing from the principles and spirit of the invention.

I claim:

1. An adjustable friction grand piano hammer shank having an end, said shank pivoted at said end on a flange comprising:

said hammer shank being bifurcated at said end into first and second portions, said bifurcated first and second portions having curved ends, a top and bottom and disposed on both sides of said flange;

a slot defined in each of said first and second bifurcated hammer shank end portions extending along a center line thereof from said end, creating upper and lower portions in each bifurcated end portion, said slots each having a front, a middle and an end;

pivot pin receipt holes defined in each of said hammer shank bifurcated end portions at the middle of said slots and also defined in said flange aligned with said pivot pin receipt holes in each of said first and second hammer shank bifurcated end portions;

a pivot pin positioned in said pivot pin receipt holes in said flange and said hammer shank bifurcated end portions pivotally holding said hammer shank to said flange;

a strap having a first and second end, said first end affixed to the bottom of said first portion of said bifurcated hammer shank, said strap extending around said curved end of said hammer shank by said slot defined in said hammer shank end, said strap further extending upwards and looping rearward back down around said second bifurcated end portion forming a loop, said strap second end affixed on the bottom of said second portion of said bifurcated hammer shank; and a friction-adjusting screw having a screw head with a lip, said screw being screwed into said hammer shank at a rearwardly disposed angle, said strap loop hooked around said lip and when said screw is tightened, pulls on said loop tightening said strap around said curved ends of said first and second bifurcated hammer shank end portions forcing said upper and lower portions of said hammer shank bifurcated ends together and tightens them against said pivot pin for greater frictional resistance to movement of said hammer shank and when said screw is loosened, said screw releases pressure on said strap loop, allowing less pressure on the upper and lower portions of said bifurcated ends reducing friction with said pivot pin for less frictional resistance to movement of said hammer shank.

2. The structure of claim 1 further including felted wool cloth disposed around said pivot pin in said pivot pin holes in said first and second bifurcated end portions.

3. The structure of claim 2 further including a stress relief hole defined in each of said first and second bifurcated end portions at the end of said slots.

* * * * *